US009972453B2

(12) United States Patent
Welch et al.

(10) Patent No.: US 9,972,453 B2
(45) **Date of Patent: *May 15, 2018**

(54) RATTLE-FREE KEYSWITCH MECHANISM

(71) Applicant: Apple Inc., Cupertino, CA (US)

(72) Inventors: Harold J. Welch, Cupertino, CA (US); Craig C. Leong, Cupertino, CA (US); James J. Niu, Cupertino, CA (US); John M. Brock, Cupertino, CA (US); Keith J. Hendren, Cupertino, CA (US); Robert L. Coish, Cupertino, CA (US); Robert S. Murphy, Cupertino, CA (US); William P. Yarak, III, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/745,427

(22) Filed: Jun. 20, 2015

(65) Prior Publication Data

US 2015/0287553 A1 Oct. 8, 2015

Related U.S. Application Data

(63) Continuation of application No. 13/792,128, filed on Mar. 10, 2013, now Pat. No. 9,064,642.

(51) Int. Cl.
*H01H 13/14* (2006.01)
*H01H 3/12* (2006.01)

(52) U.S. Cl.
CPC ..... *H01H 3/12* (2013.01); *H01H 3/125* (2013.01); *H01H 13/14* (2013.01); *H01H 2221/058* (2013.01); *H01H 2221/062* (2013.01)

(58) Field of Classification Search
CPC .. H01H 13/705; H01H 3/125; H01H 13/7065; H01H 13/70; H01H 13/704; H01H 2215/006; H01H 2221/058
USPC ..... 200/5 A, 344, 314, 341, 345, 337; 400/491.2, 490, 472
See application file for complete search history.

(56) References Cited

U.S. PATENT DOCUMENTS

| | | | |
|---|---|---|---|
| 3,657,492 | A | 4/1972 | Arndt et al. |
| 3,917,917 | A | 11/1975 | Murata |
| 3,978,297 | A | 8/1976 | Lynn et al. |
| 4,095,066 | A | 6/1978 | Harris |

(Continued)

FOREIGN PATENT DOCUMENTS

| | | |
|---|---|---|
| CN | 2155620 | 2/1994 |
| CN | 2394309 | 8/2000 |

(Continued)

OTHER PUBLICATIONS

Elekson, "Reliable and Tested Wearable Electronics Embedment Solutions," http://www.wearable.technology/our-technologies, 3 pages, at least as early as Jan. 6, 2016.

*Primary Examiner* — Edwin A. Leon
*Assistant Examiner* — Ahmed Saeed
(74) *Attorney, Agent, or Firm* — Brownstein Hyatt Farber Schreck, LLP

(57) ABSTRACT

A keyswitch mechanism having reduced key rattle and a keyboard having reduced key rattle. A rattle suppression mechanism may be formed on a portion of the scissor mechanism or on a portion of the keycap. The rattle suppression mechanism is configured to maintain force on the portion of the scissor mechanism abutting the keycap.

18 Claims, 13 Drawing Sheets

(56) References Cited

U.S. PATENT DOCUMENTS 4,319,099 A 3/1982 Asher
4,349,712 A 9/1982 Michalski
4,484,042 A 11/1984 Matsui
4,596,905 A 6/1986 Fowler
4,598,181 A 7/1986 Selby
4,670,084 A 6/1987 Durand et al.
4,755,645 A 7/1988 Naoki et al.
4,937,408 A 6/1990 Hattori et al.
4,987,275 A 1/1991 Miller et al.
5,021,638 A 6/1991 Nopper et al.
5,092,459 A 3/1992 Uljanic et al.
5,136,131 A 8/1992 Komaki
5,278,372 A 1/1994 Takagi et al.
5,280,146 A 1/1994 Inagaki et al.
5,340,955 A 8/1994 Calvillo et al.
5,382,762 A 1/1995 Mochizuki
5,408,060 A 4/1995 Muurinen
5,421,659 A 6/1995 Liang
5,422,447 A 6/1995 Spence
5,457,297 A 10/1995 Chen
5,477,430 A 12/1995 LaRose et al.
5,481,074 A 1/1996 English
5,504,283 A 4/1996 Kako et al.
5,512,719 A 4/1996 Okada et al.
5,625,532 A 4/1997 Sellers
5,804,780 A 9/1998 Bartha
5,828,015 A 10/1998 Coulon
5,847,337 A 12/1998 Chen
5,874,700 A 2/1999 Hochgesang
5,875,013 A 2/1999 Takahara
5,876,106 A 3/1999 Kordecki et al.
5,878,872 A 3/1999 Tsai
5,881,866 A 3/1999 Miyajima et al.
5,898,147 A 4/1999 Domzaiski et al.
5,924,555 A 7/1999 Sadamori et al.
5,935,691 A 8/1999 Tsai
5,960,942 A 10/1999 Thornton
5,986,227 A 11/1999 Hon
6,020,565 A 2/2000 Pan
6,068,416 A 5/2000 Kumamoto et al.
6,215,420 B1 4/2001 Harrison et al.
6,257,782 B1 7/2001 Maruyama et al.
6,259,046 B1 7/2001 Iwama et al.
6,377,685 B1 4/2002 Krishnan
6,388,219 B2 5/2002 Hsu et al.
6,423,918 B1 7/2002 King et al.
6,482,032 B1 11/2002 Szu et al.
6,530,283 B2 3/2003 Okada et al.
6,538,801 B2 3/2003 Jacobson et al.
6,542,355 B1 4/2003 Huang
6,552,287 B2 4/2003 Janniere
6,556,112 B1 4/2003 Van Zeeland et al.
6,559,399 B2 5/2003 Hsu et al.
6,560,612 B1 5/2003 Yamada et al.
6,572,289 B2 * 6/2003 Lo ..... H01H 3/125
400/491.2
6,573,463 B2 6/2003 Ono
6,585,435 B2 7/2003 Fang
6,624,369 B2 9/2003 Ito et al.
6,706,986 B2 3/2004 Hsu
6,738,050 B2 5/2004 Comiskey
6,750,414 B2 6/2004 Sullivan
6,759,614 B2 7/2004 Yoneyama
6,762,381 B2 7/2004 Kunthady et al.
6,765,503 B1 7/2004 Chan et al.
6,788,450 B2 9/2004 Kawai et al.
6,797,906 B2 9/2004 Ohashi
6,850,227 B2 2/2005 Takahashi et al.
6,860,660 B2 3/2005 Hochgesang et al.
6,911,608 B2 6/2005 Levy
6,926,418 B2 8/2005 Ostergård et al.
6,940,030 B2 9/2005 Takeda et al.
6,977,352 B2 12/2005 Oosawa
6,979,792 B1 12/2005 Lai
6,987,466 B1 1/2006 Welch et al.
6,987,503 B2 1/2006 Inoue
7,012,206 B2 3/2006 Oikawa
7,030,330 B2 4/2006 Suda
7,038,832 B2 5/2006 Kanbe
7,129,930 B1 10/2006 Cathey et al.
7,134,205 B2 11/2006 Bruennel
7,146,701 B2 12/2006 Mahoney et al.
7,151,236 B2 12/2006 Ducruet et al.
7,151,237 B2 12/2006 Mahoney et al.
7,154,059 B2 12/2006 Chou
7,166,813 B2 1/2007 Soma
7,172,303 B2 2/2007 Shipman et al.
7,189,932 B2 3/2007 Kim
7,256,766 B2 8/2007 Albert et al.
7,283,119 B2 10/2007 Kishi
7,301,113 B2 11/2007 Nishimura et al.
7,312,790 B2 12/2007 Sato et al.
7,378,607 B2 5/2008 Koyano et al.
7,385,806 B2 6/2008 Liao
7,391,555 B2 6/2008 Albert et al.
7,414,213 B2 8/2008 Hwang
7,429,707 B2 9/2008 Yanai et al.
7,432,460 B2 10/2008 Clegg
7,510,342 B2 3/2009 Lane et al.
7,531,764 B1 5/2009 Lev et al.
7,541,554 B2 6/2009 Hou
7,589,292 B2 9/2009 Jung et al.
7,639,187 B2 12/2009 Caballero et al.
7,639,571 B2 12/2009 Ishii et al.
7,679,010 B2 3/2010 Wingett
7,724,415 B2 5/2010 Yamaguchi
7,781,690 B2 8/2010 Ishii
7,813,774 B2 10/2010 Perez-Noguera
7,842,895 B2 11/2010 Lee
7,847,204 B2 12/2010 Tsai
7,851,819 B2 12/2010 Shi
7,866,866 B2 1/2011 Wahlstrom
7,893,376 B2 2/2011 Chen
7,923,653 B2 4/2011 Ohsumi
7,947,915 B2 5/2011 Lee et al.
7,999,748 B2 8/2011 Ligtenberg et al.
8,063,325 B2 11/2011 Sung et al.
8,077,096 B2 12/2011 Chiang et al.
8,080,744 B2 12/2011 Yeh et al.
8,098,228 B2 1/2012 Shimodaira et al.
8,109,650 B2 2/2012 Chang et al.
8,119,945 B2 2/2012 Lin
8,124,903 B2 2/2012 Tatehata et al.
8,134,094 B2 3/2012 Tsao et al.
8,143,982 B1 3/2012 Lauder et al.
8,156,172 B2 4/2012 Muehl et al.
8,178,808 B2 5/2012 Strittmatter et al.
8,184,021 B2 5/2012 Chou
8,212,160 B2 7/2012 Tsao
8,212,162 B2 7/2012 Zhou
8,218,301 B2 7/2012 Lee
8,232,958 B2 7/2012 Tolbert
8,246,228 B2 8/2012 Ko et al.
8,253,048 B2 8/2012 Ozias et al.
8,253,052 B2 9/2012 Chen
8,263,887 B2 9/2012 Chen et al.
8,289,280 B2 10/2012 Travis
8,299,382 B2 10/2012 Takemae et al.
8,317,384 B2 11/2012 Chung et al.
8,319,298 B2 11/2012 Hsu
8,325,141 B2 12/2012 Marsden
8,330,725 B2 12/2012 Mahowald et al.
8,354,629 B2 1/2013 Lin
8,378,857 B2 2/2013 Pance
8,383,972 B2 2/2013 Liu
8,384,566 B2 2/2013 Bocirnea
8,404,990 B2 3/2013 Lutgring et al.
8,451,146 B2 3/2013 Mahowald et al.
8,431,849 B2 4/2013 Chen
8,436,265 B2 5/2013 Koike et al.
8,462,514 B2 6/2013 Myers et al.
8,500,348 B2 8/2013 Dumont et al.
8,502,094 B2 8/2013 Chen
8,542,194 B2 9/2013 Akens et al.

(56) References Cited

U.S. PATENT DOCUMENTS 8,548,528 B2 10/2013 Kim et al.
8,569,639 B2 10/2013 Strittmatter
8,575,632 B2 11/2013 Kuramoto et al.
8,581,127 B2 11/2013 Jhuang et al.
8,592,699 B2 11/2013 Kessler et al.
8,592,702 B2 11/2013 Tsai
8,592,703 B2 11/2013 Johnson et al.
8,604,370 B2 12/2013 Chao
8,629,362 B1 1/2014 Knighton et al.
8,642,904 B2 2/2014 Chiba et al.
8,651,720 B2 2/2014 Sherman et al.
8,659,882 B2 2/2014 Liang et al.
8,731,618 B2 5/2014 Jarvis et al.
8,748,767 B2 6/2014 Ozias et al.
8,759,705 B2 6/2014 Funakoshi et al.
8,760,405 B2 6/2014 Nam
8,786,548 B2 7/2014 Oh et al.
8,791,378 B2 7/2014 Lan
8,835,784 B2 9/2014 Hirota
8,847,090 B2 9/2014 Ozaki
8,847,711 B2 9/2014 Yang et al.
8,853,580 B2 10/2014 Chen
8,854,312 B2 10/2014 Meierling
8,870,477 B2 10/2014 Merminod et al.
8,884,174 B2 11/2014 Chou et al.
8,921,473 B1 12/2014 Hyman
8,922,476 B2 12/2014 Stewart et al.
8,943,427 B2 1/2015 Heo et al.
8,976,117 B2 3/2015 Krahenbuhl et al.
8,994,641 B2 3/2015 Stewart et al.
9,007,297 B2 4/2015 Stewart et al.
9,012,795 B2 4/2015 Niu et al.
9,029,723 B2 5/2015 Pegg
9,063,627 B2 6/2015 Yairi et al.
9,064,642 B2 6/2015 Welch et al.
9,086,733 B2 7/2015 Pance
9,087,663 B2 7/2015 Los
9,093,229 B2 7/2015 Leong et al.
9,213,416 B2 12/2015 Chen
9,223,352 B2 12/2015 Smith et al.
9,234,486 B2 1/2016 Das et al.
9,235,236 B2 1/2016 Nam
9,274,654 B2 3/2016 Slobodin et al.
9,275,810 B2 3/2016 Pance et al.
9,300,033 B2 3/2016 Han et al.
9,305,496 B2 4/2016 Kimura
9,443,672 B2 9/2016 Martisauskas
9,448,628 B2 9/2016 Tan et al.
9,471,185 B2 10/2016 Guard
9,477,382 B2 10/2016 Hicks et al.
9,612,674 B2 4/2017 Degner et al.
9,761,389 B2 9/2017 Leong et al.
2002/0079211 A1 6/2002 Katayama et al.
2002/0093436 A1 7/2002 Lien
2002/0113770 A1 8/2002 Jacobson et al.
2002/0149835 A1 10/2002 Kanbe
2003/0169232 A1 9/2003 Ito
2004/0004559 A1 1/2004 Rast
2004/0225965 A1 11/2004 Garside et al.
2004/0257247 A1 12/2004 Lin et al.
2005/0035950 A1 2/2005 Daniels
2005/0253801 A1 11/2005 Kobayashi
2006/0011458 A1 1/2006 Purcocks
2006/0020469 A1 1/2006 Rast
2006/0120790 A1 6/2006 Chang
2006/0181511 A1 8/2006 Woolley
2006/0243987 A1 11/2006 Lai
2007/0200823 A1 8/2007 Bytheway et al.
2007/0285393 A1 12/2007 Ishakov
2008/0131184 A1 6/2008 Brown et al.
2008/0136782 A1 6/2008 Mundt et al.
2008/0251370 A1 10/2008 Aoki
2009/0046053 A1 2/2009 Shigehiro et al.
2009/0103964 A1 4/2009 Takagi et al.
2009/0128496 A1 5/2009 Huang
2009/0262085 A1 10/2009 Wassingbo et al.
2009/0267892 A1 10/2009 Faubert
2010/0045705 A1 2/2010 Vertegaal et al.
2010/0066568 A1 3/2010 Lee
2010/0109921 A1 5/2010 Annerfors
2010/0156796 A1 6/2010 Kim et al.
2010/0253630 A1 10/2010 Homma et al.
2011/0032127 A1 2/2011 Roush
2011/0056817 A1 3/2011 Wu
2011/0056836 A1 3/2011 Tatebe et al.
2011/0205179 A1 8/2011 Braun
2011/0261031 A1 10/2011 Muto
2011/0267272 A1 11/2011 Meyer et al.
2011/0284355 A1 11/2011 Yang
2011/0303521 A1 12/2011 Niu et al.
2012/0012446 A1 1/2012 Hwa
2012/0032972 A1 2/2012 Hwang
2012/0090973 A1 4/2012 Liu
2012/0098751 A1 4/2012 Liu
2012/0193202 A1* 8/2012 Chen ..... H01H 3/125 200/344
2012/0286701 A1 11/2012 Yang et al.
2012/0298496 A1 11/2012 Zhang
2012/0313856 A1 12/2012 Hsieh
2013/0043115 A1 2/2013 Yang et al.
2013/0093500 A1 4/2013 Bruwer
2013/0093733 A1 4/2013 Yoshida
2013/0100030 A1 4/2013 Los et al.
2013/0120265 A1 5/2013 Horii et al.
2013/0161170 A1 6/2013 Fan et al.
2013/0215079 A1 8/2013 Johnson et al.
2013/0242601 A1 9/2013 Kloeppel et al.
2013/0270090 A1 10/2013 Lee
2014/0015777 A1 1/2014 Park et al.
2014/0027259 A1 1/2014 Kawana et al.
2014/0071654 A1 3/2014 Chien
2014/0082490 A1 3/2014 Jung et al.
2014/0090967 A1 4/2014 Inagaki
2014/0098042 A1 4/2014 Kuo et al.
2014/0116865 A1 5/2014 Leong et al.
2014/0118264 A1 5/2014 Leong et al.
2014/0151211 A1 6/2014 Zhang
2014/0184496 A1 7/2014 Gribetz et al.
2014/0191973 A1 7/2014 Zellers et al.
2014/0218851 A1 8/2014 Klein et al.
2014/0252881 A1 9/2014 Dinh et al.
2014/0291133 A1 10/2014 Fu et al.
2014/0320436 A1 10/2014 Modarres et al.
2014/0346025 A1 11/2014 Hendren et al.
2014/0375141 A1 12/2014 Nakajima
2015/0016038 A1 1/2015 Niu et al.
2015/0083561 A1 3/2015 Han et al.
2015/0090570 A1 4/2015 Kwan et al.
2015/0090571 A1 4/2015 Leong et al.
2015/0227207 A1 8/2015 Winter et al.
2015/0243457 A1 8/2015 Niu et al.
2015/0270073 A1 9/2015 Yarak, III et al.
2015/0277559 A1 10/2015 Vescovi et al.
2015/0309538 A1 10/2015 Zhang
2015/0332874 A1 11/2015 Brock et al.
2015/0348726 A1 12/2015 Hendren
2015/0378391 A1 12/2015 Huitema et al.
2016/0049266 A1 2/2016 Stringer et al.
2016/0093452 A1 3/2016 Zercoe et al.
2016/0172129 A1 6/2016 Zercoe et al.
2016/0189890 A1 6/2016 Leong et al.
2016/0189891 A1 6/2016 Zercoe et al.
2016/0259375 A1 9/2016 Andre et al.
2016/0329166 A1 11/2016 Hou et al.
2016/0336124 A1 11/2016 Leong et al.
2016/0336127 A1 11/2016 Leong et al.
2016/0336128 A1 11/2016 Leong et al.
2016/0343523 A1 11/2016 Hendren et al.
2016/0351360 A1 12/2016 Knopf et al.
2016/0365204 A1 12/2016 Cao et al.
2016/0378234 A1 12/2016 Ligtenberg et al.
2016/0379775 A1 12/2016 Leong et al.

(56) References Cited

U.S. PATENT DOCUMENTS

| | | | |
|---|---|---|---|
| 2017/0004939 | A1 | 1/2017 | Kwan et al. |
| 2017/0011869 | A1 | 1/2017 | Knopf et al. |
| 2017/0090106 | A1 | 3/2017 | Cao et al. |

FOREIGN PATENT DOCUMENTS

| | | |
|---|---|---|
| CN | 1533128 | 9/2004 |
| CN | 1542497 | 11/2004 |
| CN | 2672832 | 1/2005 |
| CN | 1624842 | 6/2005 |
| CN | 1812030 | 8/2006 |
| CN | 1838036 | 9/2006 |
| CN | 1855332 | 11/2006 |
| CN | 101051569 | 10/2007 |
| CN | 200961844 | 10/2007 |
| CN | 200986871 | 12/2007 |
| CN | 101146137 | 3/2008 |
| CN | 201054315 | 4/2008 |
| CN | 201084602 | 7/2008 |
| CN | 201123174 | 9/2008 |
| CN | 201149829 | 11/2008 |
| CN | 101315841 | 12/2008 |
| CN | 201210457 | 3/2009 |
| CN | 101438228 | 5/2009 |
| CN | 101465226 | 6/2009 |
| CN | 101494130 | 7/2009 |
| CN | 101502082 | 8/2009 |
| CN | 201298481 | 8/2009 |
| CN | 101546667 | 9/2009 |
| CN | 101572195 | 11/2009 |
| CN | 101800281 | 8/2010 |
| CN | 101807482 | 8/2010 |
| CN | 101868773 | 10/2010 |
| CN | 201655616 | 11/2010 |
| CN | 102110542 | 6/2011 |
| CN | 102119430 | 7/2011 |
| CN | 201904256 | 7/2011 |
| CN | 102163084 | 8/2011 |
| CN | 201927524 | 8/2011 |
| CN | 201945951 | 8/2011 |
| CN | 201945952 | 8/2011 |
| CN | 201956238 | 8/2011 |
| CN | 102197452 | 9/2011 |
| CN | 202008941 | 10/2011 |
| CN | 202040690 | 11/2011 |
| CN | 102280292 | 12/2011 |
| CN | 102338348 | 2/2012 |
| CN | 102375550 | 3/2012 |
| CN | 202205161 | 4/2012 |
| CN | 102496509 | 6/2012 |
| CN | 10269527 | 8/2012 |
| CN | 102622089 | 8/2012 |
| CN | 102629526 | 8/2012 |
| CN | 202372927 | 8/2012 |
| CN | 102679239 | 9/2012 |
| CN | 102683072 | 9/2012 |
| CN | 202434387 | 9/2012 |
| CN | 202523007 | 11/2012 |
| CN | 102832068 | 12/2012 |
| CN | 102955573 | 3/2013 |
| CN | 102956386 | 3/2013 |
| CN | 102969183 | 3/2013 |
| CN | 103000417 | 3/2013 |
| CN | 103165327 | 6/2013 |
| CN | 103180979 | 6/2013 |
| CN | 203012648 | 6/2013 |
| CN | 203135988 | 8/2013 |
| CN | 103377841 | 10/2013 |
| CN | 103489986 | 1/2014 |
| CN | 203414880 | 1/2014 |
| CN | 103681056 | 3/2014 |
| CN | 103699181 | 4/2014 |
| CN | 203520312 | 4/2014 |
| CN | 203588895 | 5/2014 |
| CN | 103839715 | 6/2014 |
| CN | 103839720 | 6/2014 |
| CN | 103839722 | 6/2014 |
| CN | 103903891 | 7/2014 |
| CN | 103956290 | 7/2014 |
| CN | 203733685 | 7/2014 |
| CN | 104021968 | 9/2014 |
| CN | 204102769 | 1/2015 |
| CN | 204117915 | 1/2015 |
| CN | 104517769 | 4/2015 |
| CN | 204632641 | 9/2015 |
| CN | 105097341 | 11/2015 |
| DE | 2530176 | 1/1977 |
| DE | 3002772 | 7/1981 |
| DE | 29704100 | 4/1997 |
| DE | 202008001970 | 8/2008 |
| EP | 0441993 | 8/1991 |
| EP | 1835272 | 9/2007 |
| EP | 1928008 | 6/2008 |
| EP | 2022606 | 6/2010 |
| EP | 2426688 | 3/2012 |
| EP | 2439760 | 4/2012 |
| EP | 2463798 | 6/2012 |
| EP | 2664979 | 11/2013 |
| FR | 2147420 | 3/1973 |
| FR | 2911000 | 7/2008 |
| FR | 2950193 | 3/2011 |
| GB | 1361459 | 7/1974 |
| JP | S50115562 | 9/1975 |
| JP | S60055477 | 3/1985 |
| JP | S61172422 | 10/1986 |
| JP | S62072429 | 4/1987 |
| JP | S63182024 | 11/1988 |
| JP | H0422024 | 4/1992 |
| JP | H0520963 | 1/1993 |
| JP | H0524512 | 8/1993 |
| JP | H05342944 | 12/1993 |
| JP | H09204148 | 8/1997 |
| JP | H10312726 | 11/1998 |
| JP | H11194882 | 7/1999 |
| JP | 2000010709 | 1/2000 |
| JP | 2000057871 | 2/2000 |
| JP | 2000339097 | 12/2000 |
| JP | 2001100889 | 4/2001 |
| JP | 2003114751 | 9/2001 |
| JP | 2002260478 | 9/2002 |
| JP | 2002298689 | 10/2002 |
| JP | 2003522998 | 7/2003 |
| JP | 2005108041 | 4/2005 |
| JP | 2006164929 | 6/2006 |
| JP | 2006185906 | 7/2006 |
| JP | 2006521664 | 9/2006 |
| JP | 2006269439 | 10/2006 |
| JP | 2006277013 | 10/2006 |
| JP | 2006344609 | 12/2006 |
| JP | 2007115633 | 5/2007 |
| JP | 2007514247 | 5/2007 |
| JP | 2007156983 | 6/2007 |
| JP | 2008021428 | 1/2008 |
| JP | 2008041431 | 2/2008 |
| JP | 2008100129 | 5/2008 |
| JP | 2008191850 | 8/2008 |
| JP | 2008533559 | 8/2008 |
| JP | 2008293922 | 12/2008 |
| JP | 2009099503 | 5/2009 |
| JP | 2009181894 | 8/2009 |
| JP | 2010061956 | 3/2010 |
| JP | 2010244088 | 10/2010 |
| JP | 2010244302 | 10/2010 |
| JP | 2011018484 | 1/2011 |
| JP | 2011065126 | 3/2011 |
| JP | 2011150804 | 8/2011 |
| JP | 2011165630 | 8/2011 |
| JP | 2011524066 | 8/2011 |
| JP | 2011187297 | 9/2011 |
| JP | 2012022473 | 2/2012 |
| JP | 2012043705 | 3/2012 |
| JP | 2012063630 | 3/2012 |
| JP | 2012098873 | 5/2012 |
| JP | 2012134064 | 7/2012 |

(56) References Cited

FOREIGN PATENT DOCUMENTS

| | | |
|---|---|---|
| JP | 2012186067 | 9/2012 |
| JP | 2012230256 | 11/2012 |
| JP | 2014017179 | 1/2014 |
| JP | 2014026807 | 2/2014 |
| JP | 2014216190 | 11/2014 |
| JP | 2014220039 | 11/2014 |
| JP | 2016053778 | 4/2016 |
| KR | 1019990007394 | 1/1999 |
| KR | 1020020001668 | 1/2002 |
| KR | 100454203 | 10/2004 |
| KR | 1020060083032 | 7/2006 |
| KR | 1020080064116 | 7/2008 |
| KR | 1020080066164 | 7/2008 |
| KR | 2020110006385 | 6/2011 |
| KR | 1020120062797 | 6/2012 |
| KR | 1020130040131 | 4/2013 |
| KR | 20150024201 | 3/2015 |
| TW | 200703396 | 1/2007 |
| TW | M334397 | 6/2008 |
| TW | 201108284 | 3/2011 |
| TW | 201108286 | 3/2011 |
| TW | M407429 | 7/2011 |
| TW | 201246251 | 11/2012 |
| TW | 201403646 | 1/2014 |
| WO | WO9744946 | 11/1997 |
| WO | WO2005/057320 | 6/2005 |
| WO | WO2006/022313 | 3/2006 |
| WO | WO2007/049253 | 5/2007 |
| WO | WO2008/045833 | 4/2008 |
| WO | WO2009/005026 | 1/2009 |
| WO | WO2012/011282 | 1/2012 |
| WO | WO2012/027978 | 3/2012 |
| WO | WO2013/096478 | 6/2013 |
| WO | WO2014175446 | 10/2014 |

* cited by examiner

RATTLE-FREE KEYSWITCH MECHANISM

This application is a continuation of U.S. patent application Ser. No. 13/792,128, filed on Mar. 10, 2013, and entitled "RATTLE-FREE KEYSWITCH MECHANISM," which is incorporated by reference in its entirety as if fully disclosed herein.

TECHNICAL FIELD

The present invention relates to keyboards generally and keyboard keyswitch mechanisms particularly.

BACKGROUND

Electronic devices are ubiquitous in society and can be found in everything from household appliances to computers. Many electronic devices include a keyboard or keypad. These keyboards or keypads include keyswitches that may rattle undesirably at various times, such as during typing, when brushing across them, when carrying the electronic device, or when the device is subjected to any form of vibration. In any of these situations this rattling may detract from the user's perception of quality or enjoyment of the device. Additionally, key rattle may lead to wear within the keyswitch mechanism, becoming worse over time and potentially leading to further issues with the functioning of the keyboard. Thus, key rattling may generally be assumed to be a negative trait for electronic devices.

One source of this key rattling originates from various pieces of certain keyswitch mechanisms knocking against one another during operation or other activities, such as those described above. In many scissor-type keyswitch mechanisms, such knocking typically results from clearances between mating features of the mechanism that are included to avoid any binding of components of the switch mechanism when it is operated.

Sample embodiments described herein utilize various approaches to reduce key rattling within electronic devices, while maintaining non-binding operation of example keyswitch mechanisms.

SUMMARY

One sample embodiment, as described herein, is a keyswitch mechanism having reduced key rattle. The keyswitch mechanism includes: a base having a surface; a scissor mechanism slidably coupled to the base; a keycap abutting the scissor mechanism; and a rattle suppression mechanism formed on a portion of the scissor mechanism. The rattle suppression mechanism is configured to maintain force on the portion of the scissor mechanism abutting the keycap.

Another example embodiment of the present invention is a keyswitch mechanism having reduced key rattle. The keyswitch mechanism includes: a base having a surface; a scissor mechanism slidably coupled to the base; and a keycap abutting the scissor mechanism. The keycap includes a rattle suppression mechanism that is configured to maintain force on a portion of the scissor mechanism abutting the keycap.

A further example embodiment of the present invention is a keyboard having reduced key rattle. The keyboard includes: a backplate; a wiring layer coupled to the backplate; a housing coupled to the backplate and configured to hold a plurality of keys; and the plurality of keys. Each key includes: a key base mechanically coupled to at least one of the backplate or the housing; a dome switch mechanically coupled to the key base and electrically coupled to the wiring layer; a scissor mechanism slidably coupled to the key base; a keycap mechanically coupled to the dome switch and abutting the scissor mechanism; and a rattle suppression mechanism. The rattle suppression mechanism is formed on a portion of the scissor mechanism or on a portion of the keycap. The rattle suppression mechanism is configured to maintain force on the portion of the scissor mechanism abutting the keycap.

While multiple embodiments are disclosed, including variations thereof, still other embodiments of the present disclosure will become apparent to those skilled in the art from the following detailed description, which shows and describes illustrative embodiments of the disclosure. As will be realized, the disclosure is capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the present disclosure, it is believed that the embodiments are best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures:

DETAILED DESCRIPTION

Figure 1:
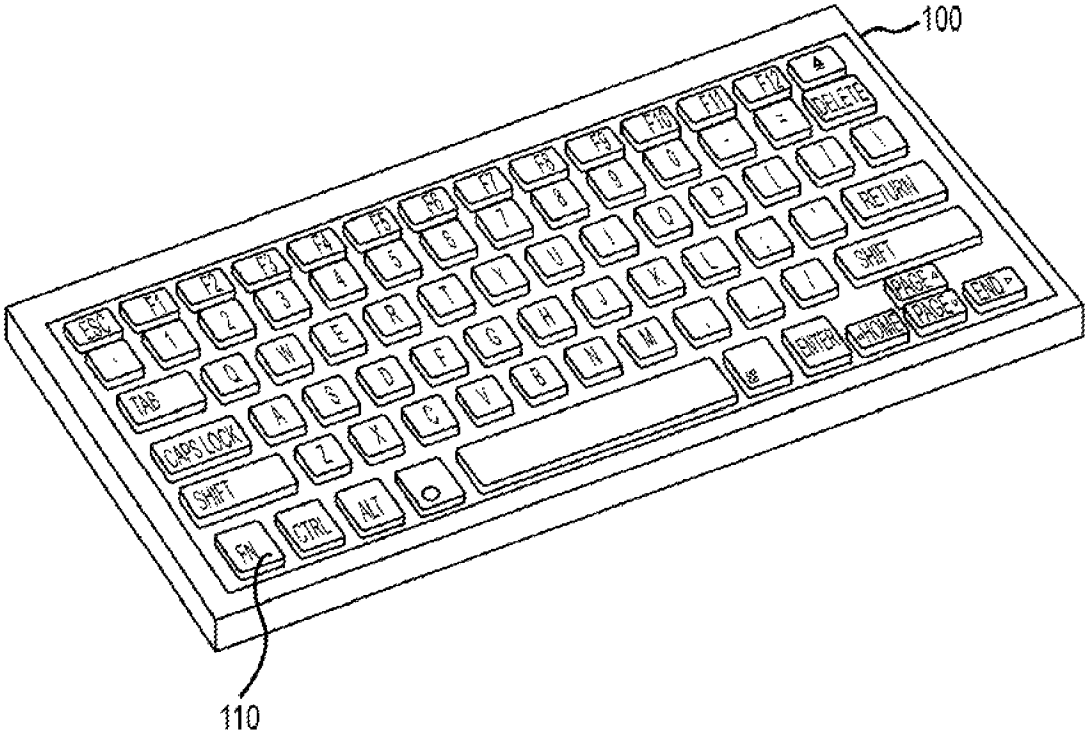
FIG. 1 is a perspective drawing of an example keyboard.

FIG. 1 generally depicts a keyboard 100. Although the keyboard is shown as stand-alone, it should be appreciated that the discussion herein applies generally to all keyboards, whether stand-alone or integrated into another product such as a laptop computer. Likewise, certain principles discussed herein may be applied to other input and/or output devices that include keys, such as mice, trackballs, keypads, and the like. The keyboard may be considered an "input device" and each key an "input mechanism."

Figure 2:
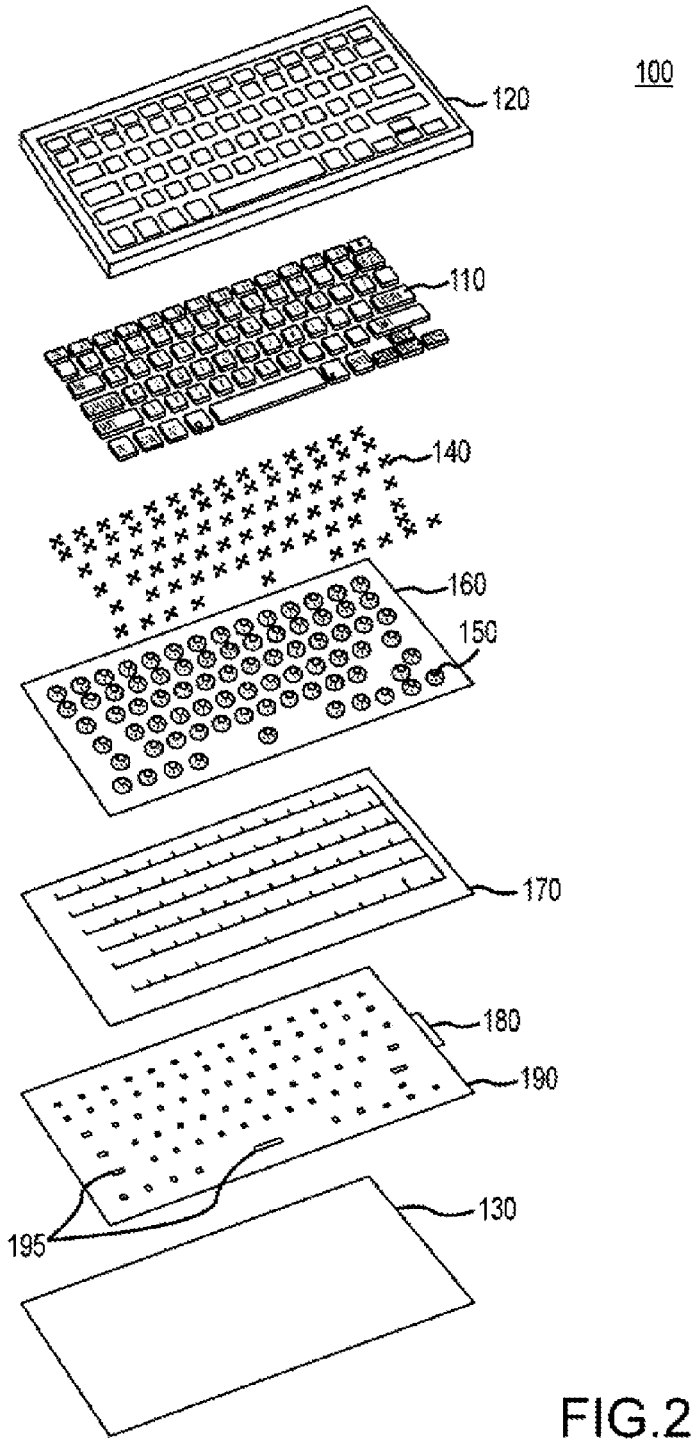
FIG. 2 is an exploded perspective drawing of the keyboard of FIG. 1.

The keyboard 100 of FIG. 1 includes multiple keys with keycaps 110. FIG. 2 generally shows an exploded view of the keyboard 100 of FIG. 1. As shown, the keyboard typically includes multiple layers. The individual keycaps 110 are at least partially contained within a housing or faceplate 120 that surrounds the keyboard. A backplate 130 may define a bottom portion of the housing 120. Each key is attached to a scissor mechanism 140 that biases the key upward. As the keycap 110 of a key is pressed, the scissor collapses, permitting the key to travel downward. This motion also collapses a dome switch 150 located beneath the keyboard. The dome switches 150 all may be formed on a single dome switch layer 160. A metal patch is formed at the top of the dome. When this patch impacts a contact on the wiring layer 170 beneath the dome. The wiring layer is connected to a microprocessor, which detects the closed circuit, registers it as a key press and generates an output or otherwise processes the closed circuit accordingly. A support layer (not shown) may be located adjacent the wiring layer to provide structural stiffness to the wiring.

In another embodiment, the downward motion of the key 110 pushes a plunger or other protrusion through a hole at the top of a dome 150. The plunger, which generally has an end made of metal or that is otherwise electrically conductive, touches a contact on the bottom of the dome switch when the keyboard is sufficiently depressed. This contact creates a closed circuit with the results discussed above.

As also shown in FIG. 2, many keyboards 100 may include an illumination system that backlights one or more individual keys. To be backlit, a key generally has its legend, symbol or the like etched through the paint or other opaque surface of the keycap 110. Oftentimes, this etching is in the shape of the letter, number or symbol corresponding to the key's input. One or more light-emitting diodes (LEDs) 180 may be positioned around the exterior of a light guide. (In some cases, one or more LEDs may also be placed in apertures within the light guide.) Light is emitted by the LEDs into the light guide 190, which is formed from a transparent or translucent material that permits the light to propagate therethrough. A pattern of microlenses 195 may be formed on the light guide 190. As light emitted from the LEDs 180 enters the microlenses 195, the light is redirected to be emitted upward and out of the microlenses.

As noted above, one issue with keyboards and other key-based input devices used in consumer electronics is key rattle. A common source of this key rattle is space that is often left for clearance of various mechanical components to prevent binding in the keyswitch mechanism during operation of the key. This space may allow the components to move in undesired directions and/or magnitudes, producing key rattle.

Embodiments described herein may include a number of example embodiments designed to reduce the amount of key rattle associated with key-based input devices. Some of these example embodiments include features to apply pressure to certain mechanical components within these keyswitch mechanisms to reduce these components' freedom to move in undesired directions and/or magnitudes, thus reducing, or potentially eliminating, key rattle associated with these motions. Additionally, some example embodiments include features to dampen the motion of certain mechanical components within these keyswitch mechanisms, which may also reduce, or potentially eliminate, key rattle associated with these components. One skilled in the art will understand that, although illustrated separately for clarity, many of these example embodiments may be used in conjunction to further improve the stability of the keyswitch mechanism and reduce key rattle.

Figure 3A:
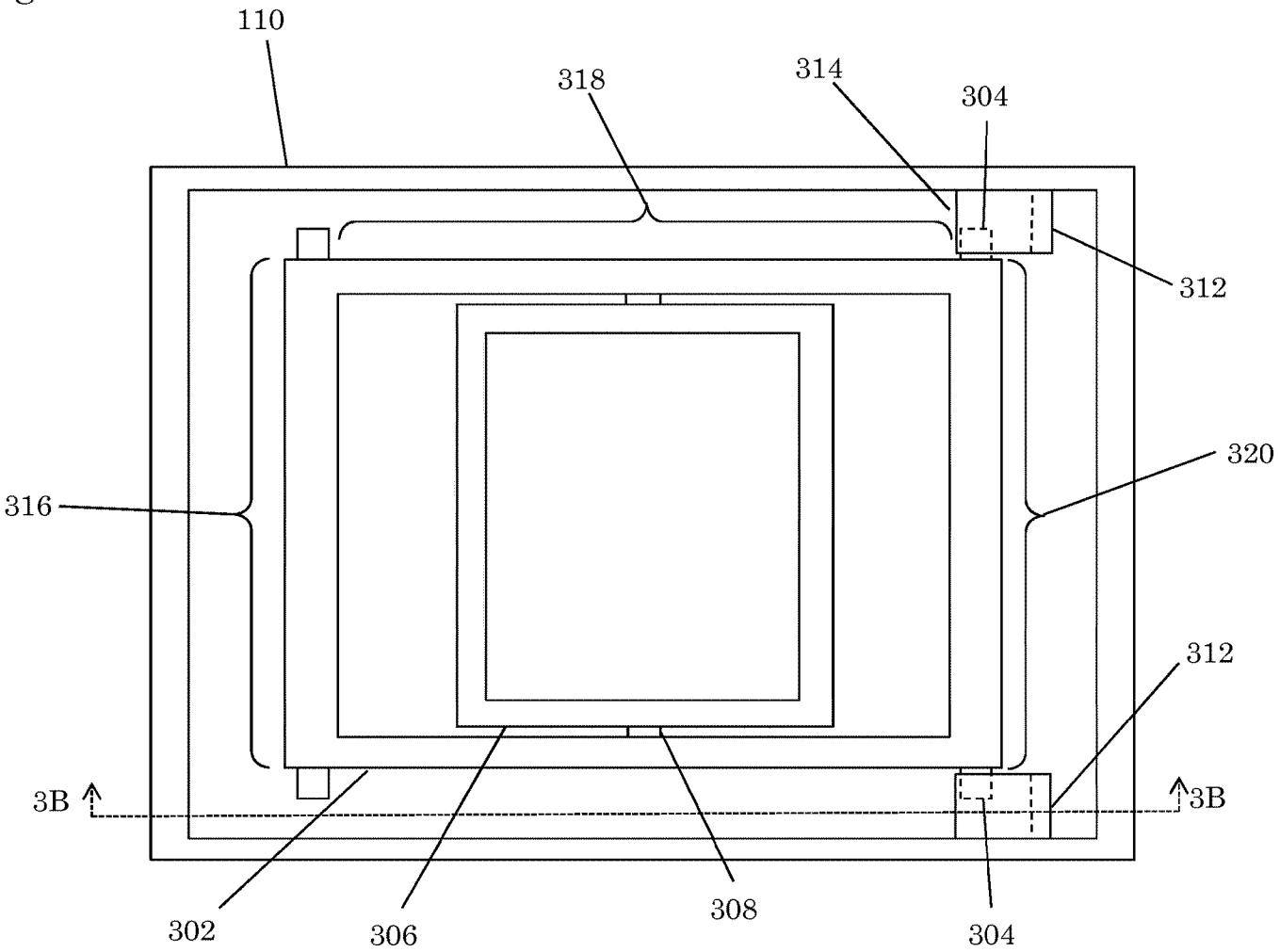
FIG. 3A is bottom plan drawing of an example keyswitch mechanism.
Figure 3B:
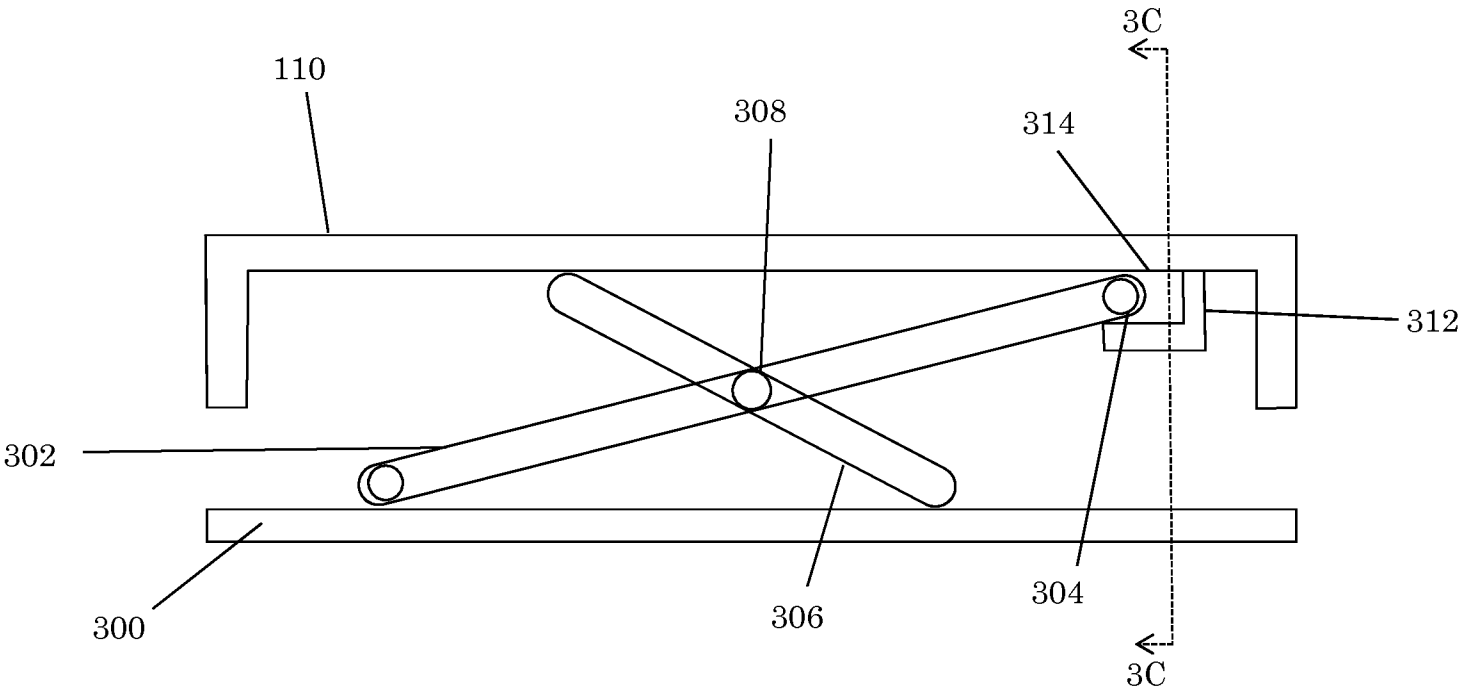
FIG. 3B is side cut-away drawing of the example keyswitch mechanism of FIG. 3A along line 3B-3B.
Figure 3C:
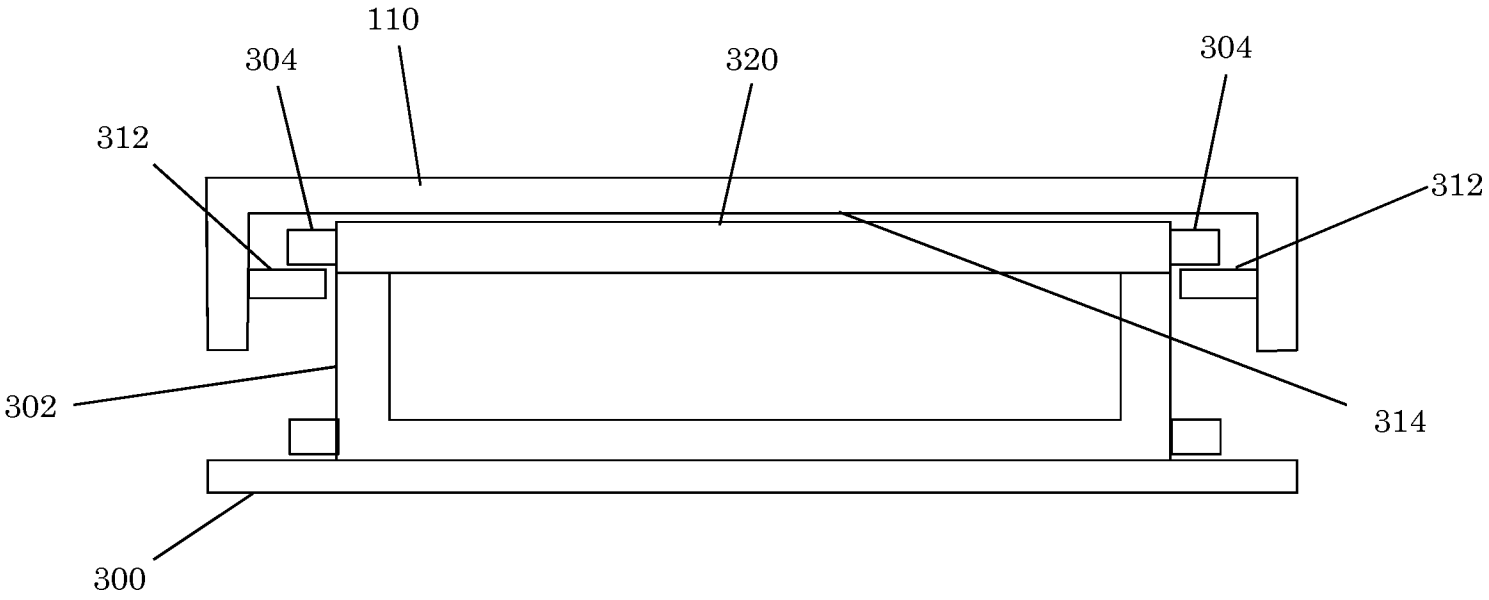
FIG. 3C is front cut-away drawing of the example keyswitch mechanism of FIGS. 3A and 3B along line 3C-3C.

FIGS. 3A-C provide three orthogonal views to illustrate, in more detail than FIG. 2, an example basic scissor-type keyswitch mechanism that may be used in keyboards and other key-based input devices. Various sample embodiments are illustrated in FIGS. 4A-C, 5A, 5B, 6A, 6B, and 7. The embodiments illustrated in detail by these figures include various example features that may be used in conjunction with the underlying scissor-type keyswitch mechanism of FIGS. 3A-C. This example keyswitch mechanism includes: base 300; a scissor mechanism; and keycap 110. It is noted that FIG. 3A, which is a bottom plan drawing, does not include base 300; and FIG. 3C, which is a front cut-away drawing, does not include the second scissor arm or pivots of the example scissor mechanism. One skilled in the art may understand that these omissions do not indicate a lack of these elements, but rather these omissions serve to reduce clutter in the figures and simplify viewing the other components of the example keyswitch mechanism.

The example scissor mechanism of FIGS. 3A-C includes: first scissor arm 302; second scissor arm 306; pivots 308 to couple first scissor arm 302 and second scissor arm 306 such that these scissor arms may rotate about this pivots; and scissor slide pins 304 to slidably couple first scissor arm 302 to keycap 110. Pivots 308 may be bearing or they may be formed out of flexible material coupling the scissor arms. Such flexible pivots 308 may provide the bias to extend the key when keycap 110 is depressed then released.

Second scissor arm 306 is shown in FIG. 3B as having ends in contact with, but not fixedly coupled to, base 300 and keycap 110, while first scissor arm 306 is rotatably coupled to base 300. Thus, during operation of the example key, the ends of second scissor arm 306 may freely slide over the surfaces of both base 300 and keycap 110.

First scissor arm 302 is may be formed as a frame that includes: base bar 316, which is substantially parallel to the surface of base 300 to which it is rotatably coupled; two parallel side bars 318 extending perpendicular to base bar 316 from its ends and coupled to second scissor arm 306 by pivots 308; and keycap bar 320, which extends between side bars 318 opposite base bar 316.

Base bar 316 is illustrated in FIGS. 3A-C as including pins at either end that extend outside of the axes of side bars 318. These pins may be used to rotatably couple first scissor arm 302 to base 300. Alternatively, first scissor arm 302 may be rotatably coupled to base 300 at an intermediate portion of base bar 316 and these pins may be omitted.

Scissor pins 304 are coupled to the first frame arm at the end of keycap bar 320 and may extend outside of the axes of side bars 318 collinear to the axis of keycap bar 320. In an example assembled key, scissor pins 304 are held in slide grooves 312 of keycap 110 and are capable of sliding within these slide grooves during operation of the key. Also during operation of the key, keycap bar 320 slides along scissor contact surface 314 of keycap 110.

FIG. 3C illustrates how clearances within an example keyswitch mechanism may lead to spaces between various mechanical components of the mechanism. For example, keycap bar 320 of first scissor arm 302 is illustrated as not being in direct contact with scissor contact surface 314 of keycap 110 and scissor pins 304 of the scissor mechanism are not in direct contact with slide groves 312 of keycap 110.

These gaps have been exaggerated for illustrative purposes, but they may represent the sort of spaces that can result from clearances between components, such as first scissor arm 302 and slide groove 312 of keycap 110 (shown in FIG. 3B), which are employed to avoid binding of the scissor mechanism during operation. Such gaps between keyswitch components may lead to key rattle.

Figure 4A:
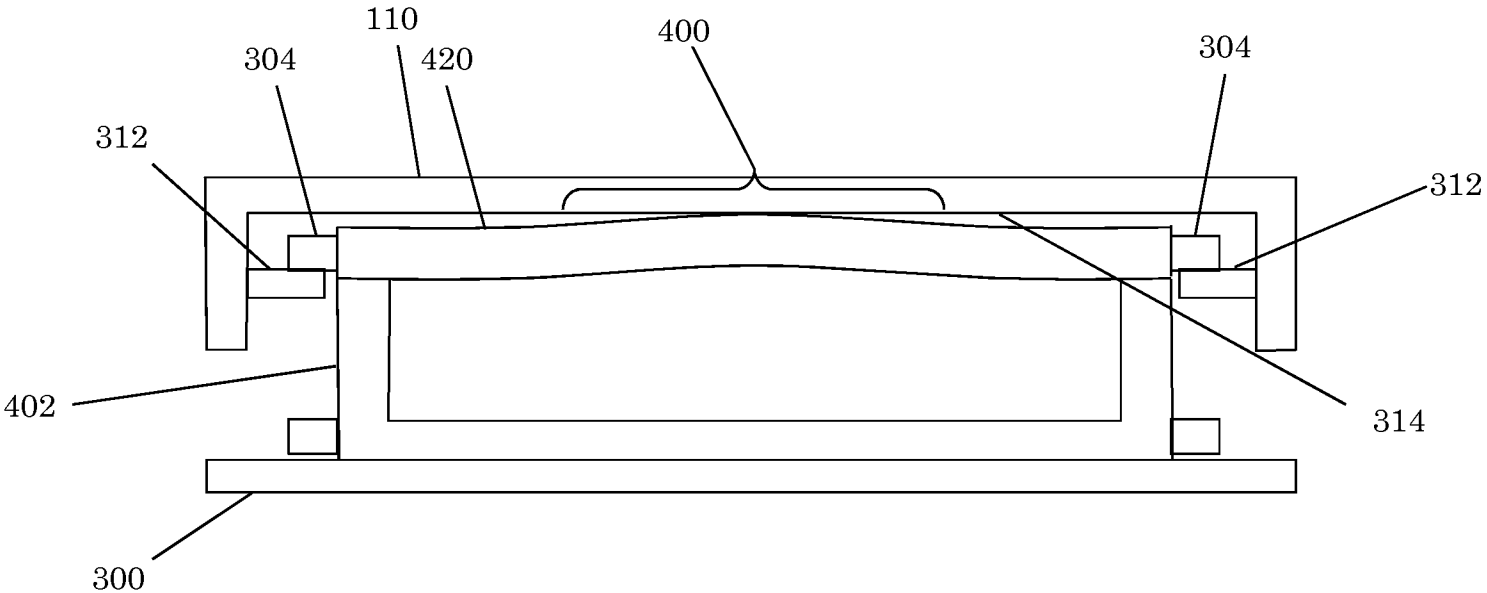
FIG. 4A front cut-away drawing of an example keyswitch mechanism according to an embodiment.

FIG. 4A illustrates one embodiment that may reduce key rattle in scissor-type keyswitch mechanisms by tightening a fit of scissor slide pins 304 of the scissor mechanism within slide grooves 312 of keycap 110.

In the example embodiment of FIGS. 3A-C, the use of clearances to avoid binding of the scissor mechanism leads to spaces between various mechanical components of the keyswitch mechanism. These spaces may also allow unintended movement of these components relative to each other, which is a potential source of key rattle. For example, as illustrated in FIG. 3A, this example keyswitch mechanism may include gaps between scissor slide pins 304 of the scissor mechanism and corresponding slide grooves 312 of keycap 310, as well as a gap between keycap bar 320 of first scissor arm 302 and scissor contact surface 314 of keycap 110.

In the example embodiment of FIG. 4A, however, keycap bar 420 of first scissor arm 402 includes a rattle suppression feature, namely arch 400. Arch 400 of keycap bar 420 extends in a direction perpendicular to the axis of keycap bar 420 (and substantially perpendicular to the axes of the side bars of first scissor arm 402) to press against scissor contact surface 314 of keycap 110. This pressure on keycap bar 420 may cause first scissor arm 402 to pivot slightly, bringing scissor slide pins 304 of the scissor mechanism into contact with the contact surfaces of slide grooves 312 of keycap 310. In this way, arch 400 in keycap bar 420 may suppress key rattle in the example keyswitch mechanism by tightening the fit of scissor slide pins 304 within slide grooves 312.

It may be noted that the use of arch 400 in keycap bar 420 as a rattle suppression mechanism in the example keyswitch mechanism of FIG. 4A may reduce (or possibly eliminate) the clearances between mechanical components in the mechanism. To avoid binding of the keyswitch mechanism during key operation, it may be useful for at least a portion of keycap bar 420 to be elastically deformable along the direction that the rattle suppression feature, arch 400, extends, e.g. at least partially flattening arch 400. This elastic deformation may be due to flexibility of keycap bar 420 along its axis or to compressibility of the material in arch 400, or to both.

Such elastic deformability of keycap bar 420 may not only be useful to avoid binding of the keyswitch mechanism, but it may also be useful to allow scissor slide pins 304 of the scissor mechanism to maintain a constant contact with the contact surfaces of slide grooves 312 of keycap 310, even when a force is exerted on a portion of keycap 110 that may cause the keycap to tilt or drop. For example, in the example key switch mechanism of FIGS. 3A-C, key rattle may occur due to pressure on one side of the key, which may cause the other side to rise in such a way that scissor slide pins 304 may engage and disengage with the contact surfaces of slide grooves 312 or keycap bar 320 may click against scissor contact surface 314. Alternatively, when the key is released the contact surfaces of slide grooves 312 may rebound and clicks against scissor slide pins 304. By placing a constant bias pressure on various mechanical components of the example keyswitch mechanism in the example embodiment of FIG. 4A, the elastic deformation of keycap bar 420 may reduce key rattle from these multiple sources.

Figure 4B:
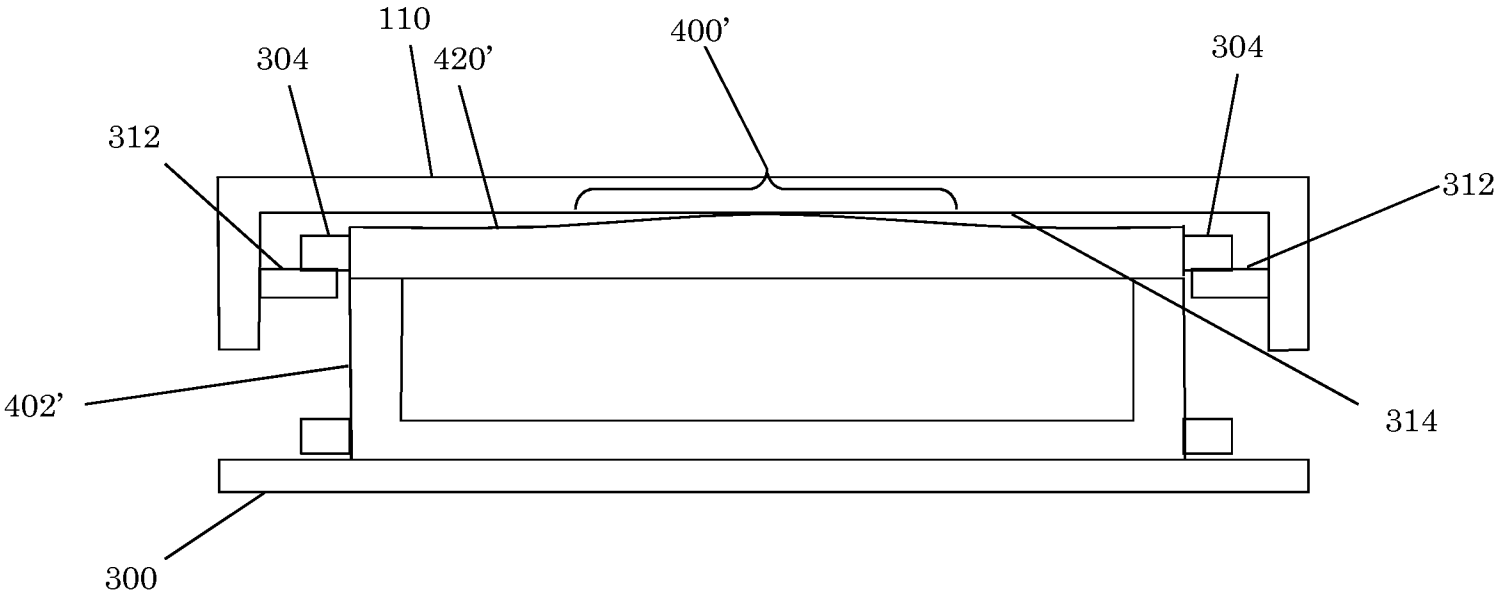
FIG. 4B is front cut-away drawing of another example keyswitch mechanism according to an embodiment.

FIG. 4B illustrates another sample embodiment. In this example embodiment keycap bar 420' includes bump 400' as a rattle suppression feature, rather than arch 400. This example embodiment functions similarly to the example embodiment of FIG. 4A, reducing key rattle by tightening the fit of scissor slide pins 304 within slide grooves 312.

Figure 4C:
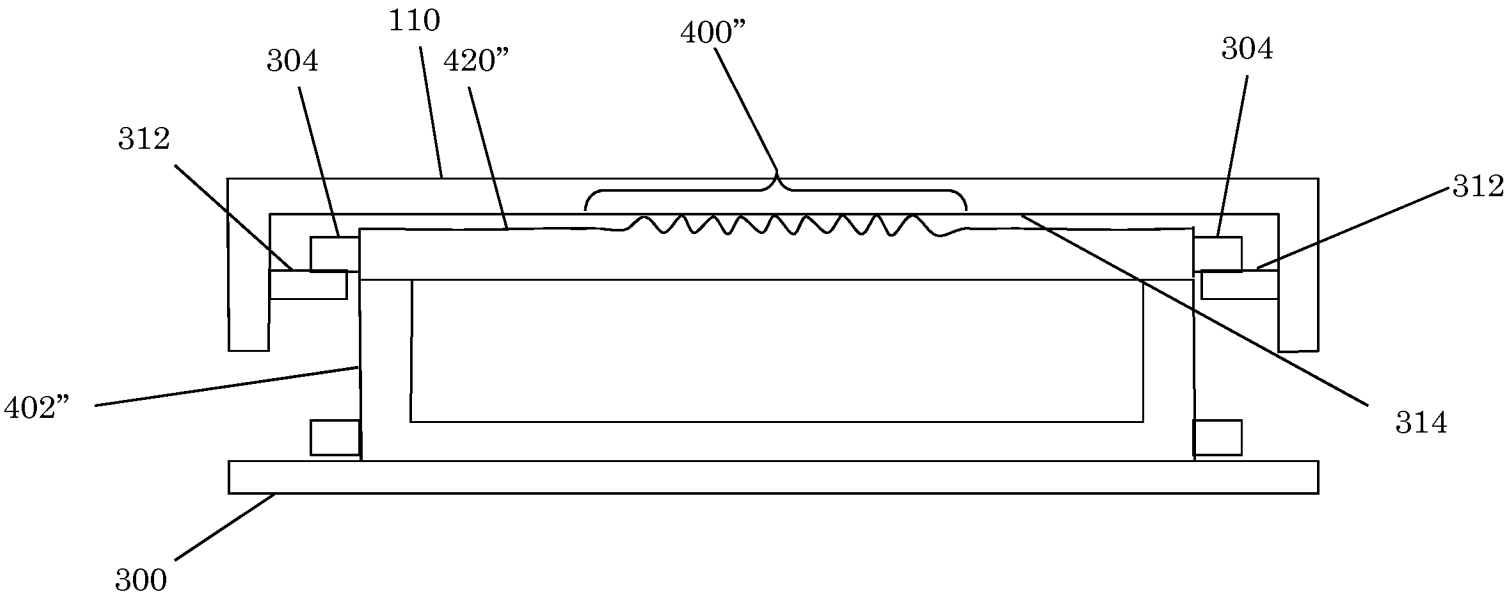
FIG. 4C is front cut-away drawing of a further example keyswitch mechanism according to an embodiment.

FIG. 4C illustrates a further sample embodiment. In this example embodiment keycap bar 420" includes a series of ridges 400', as a rattle suppression feature, rather than arch 400 or bump 400'. This example embodiment also functions similarly to the example embodiments of FIGS. 4A and 4B, reducing key rattle by tightening the fit of scissor slide pins 304 within slide grooves 312.

One skilled in the art may understand that the example embodiments of FIGS. 4B and 4C may have the same issue of possible binding as the example embodiment of FIG. 4A. Thus, it may be useful for a portion of keycap bars or associated rattle suppression features to be elastically deformable in these example embodiments as well.

Figure 5A:
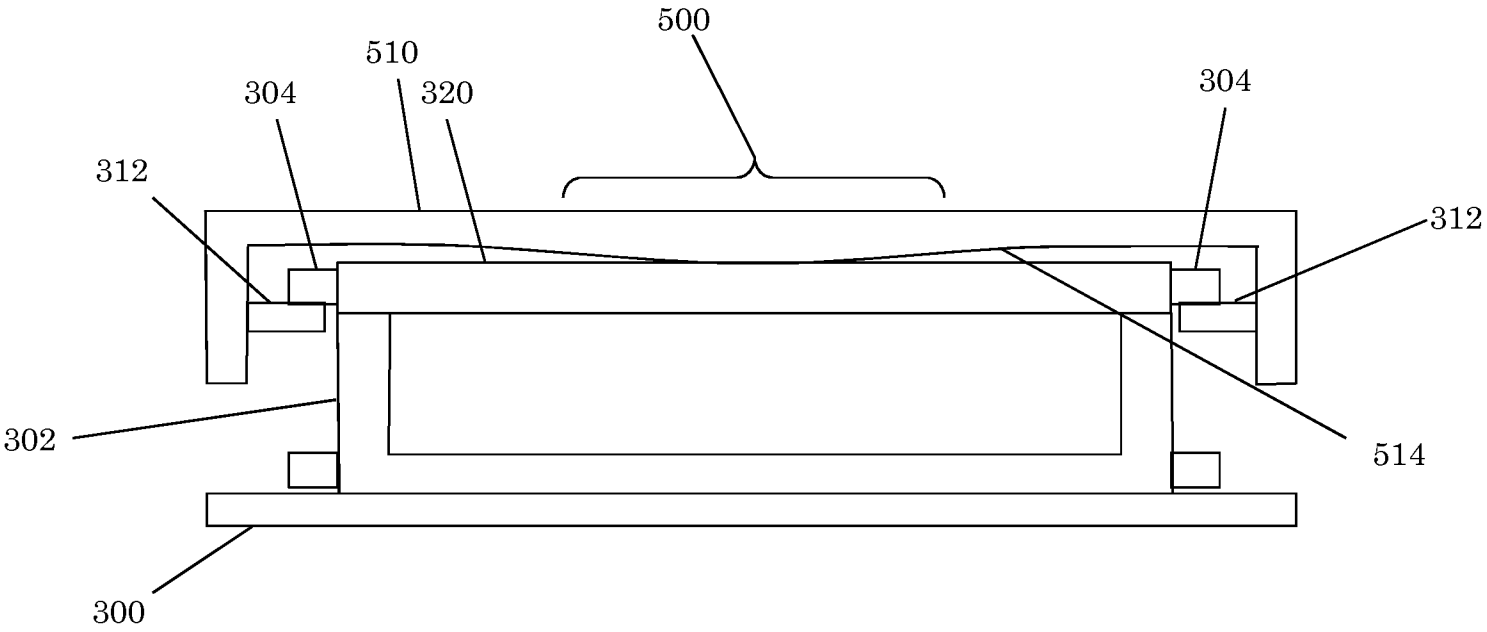
FIG. 5A is front cut-away drawing of an additional example keyswitch mechanism according to an embodiment.

FIG. 5A illustrates an additional sample keyswitch mechanism having reduced key rattle. In this example embodiment, scissor contact surface 514 of keycap 510 includes a rattle suppression feature, bump 500. Bump 500 functions similarly to the example rattle suppression features of FIG. 4A-C (arch 400, bump 400', and ridges 400"), tightening the fit of scissor slide pins 304 within slide grooves 312 of keycap 510, albeit by bump 500 on scissor contact surface 514 of keycap 510 pressing keycap bar 320 of first scissor arm 302 rather than by a rattle suppression feature on the keycap bar of the first scissor arm pressing on scissor contact surface 314 of keycap 110. Similarly to the example embodiments of FIGS. 4A-C, it may be useful for the rattle suppression feature, bump 500, to be elastically deformable to avoid issues of components binding.

Figure 5B:
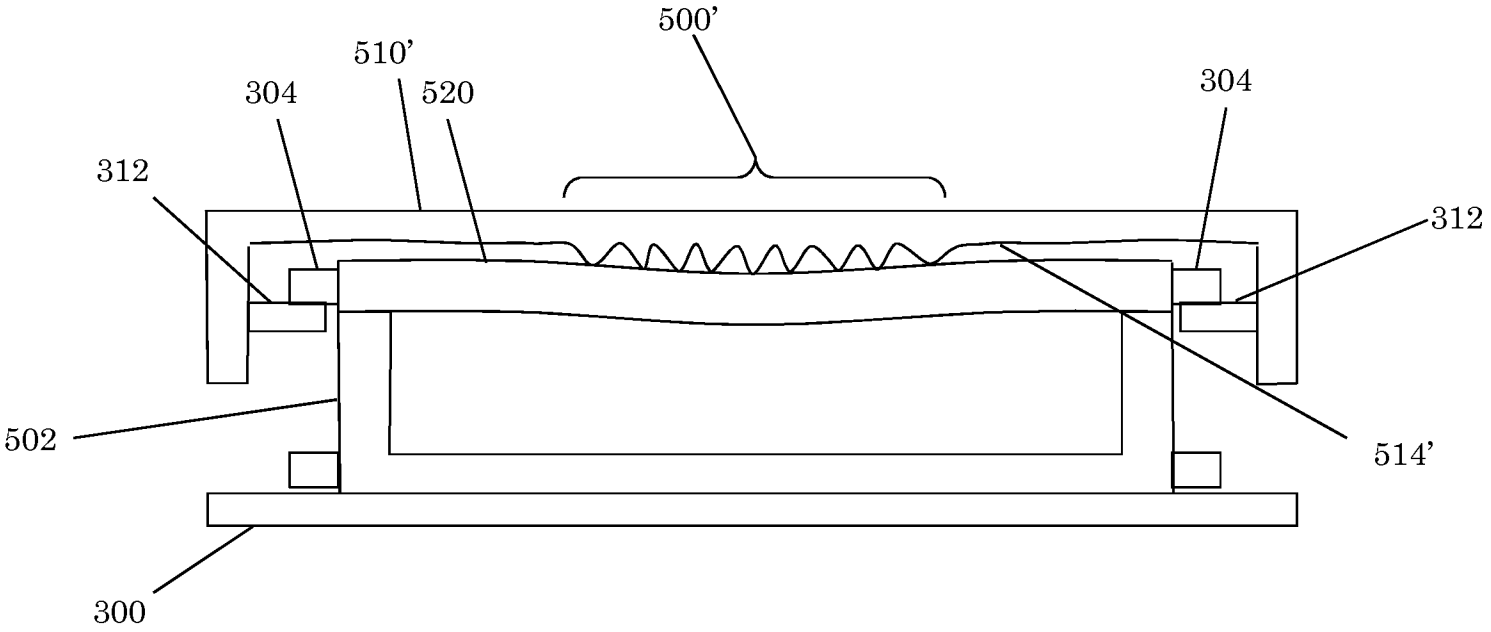
FIG. 5B is front cut-away drawing of yet another example keyswitch mechanism according to an embodiment.

FIG. 5B illustrates yet another example keyswitch mechanism having reduced key rattle. In this embodiment, scissor contact surface 514' of keycap 510' includes a rattle suppression feature, a series of ridges 500'. Ridges 500' function similarly to bump 500 of FIG. 5A, pressing on keycap bar 520 of first scissor arm 502 to tighten the fit of scissor slide pins 304 within slide grooves 312 of keycap 510.

As in the example embodiments of FIGS. 4A-C and 5A, it may be useful for the rattle suppression feature, ridges 500', to be elastically deformable to avoid or prevent components from binding. The example keyswitch mechanism of FIG. 5B includes an additional feature that may avoid issues of components binding. In this example embodiment, at least a portion of keycap bar 520 of first scissor arm 502 is elastically deformable. This elastically deformable portion of keycap bar 520 of first scissor arm 502 may be flexible or compressible. Although not shown in FIG. 5A, one skilled in the art may understand that this example feature may be used conjunction with the example embodiment of FIG. 5A.

Figure 6A:
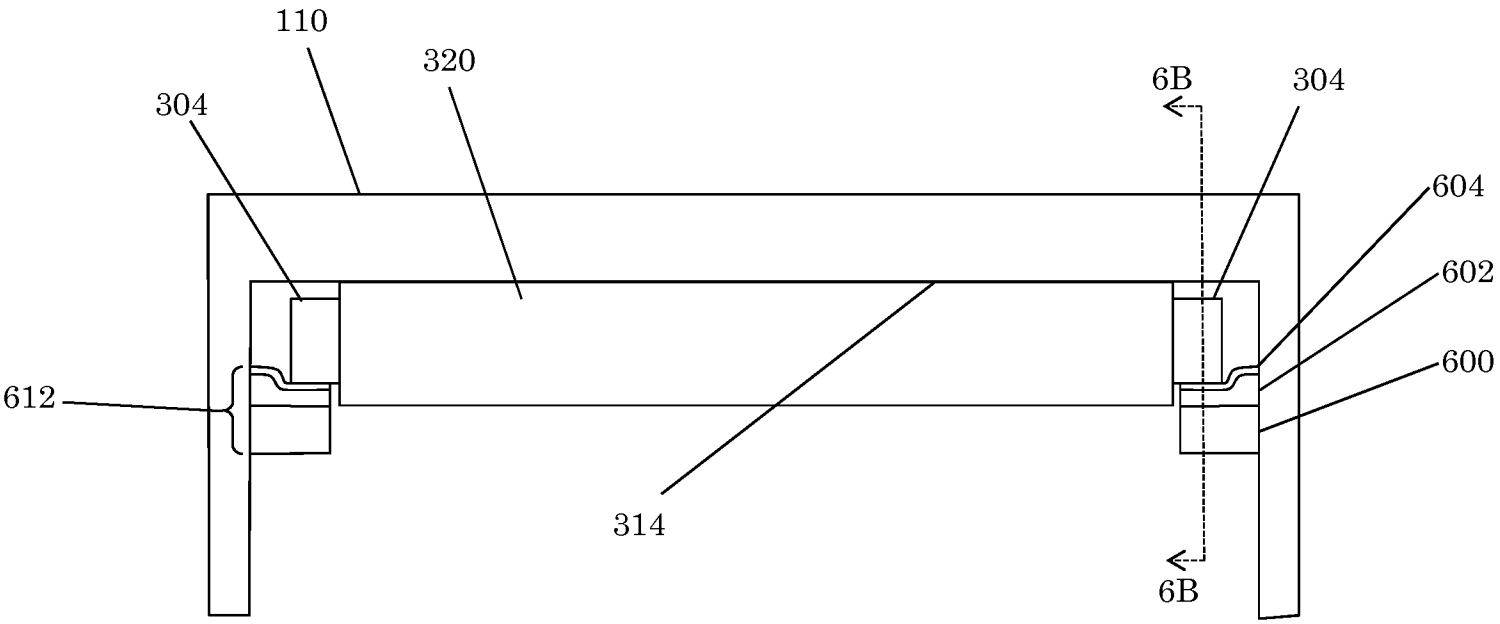
FIG. 6A is front cut-away drawing of yet a further example keyswitch mechanism according to an embodiment.
Figure 6B:
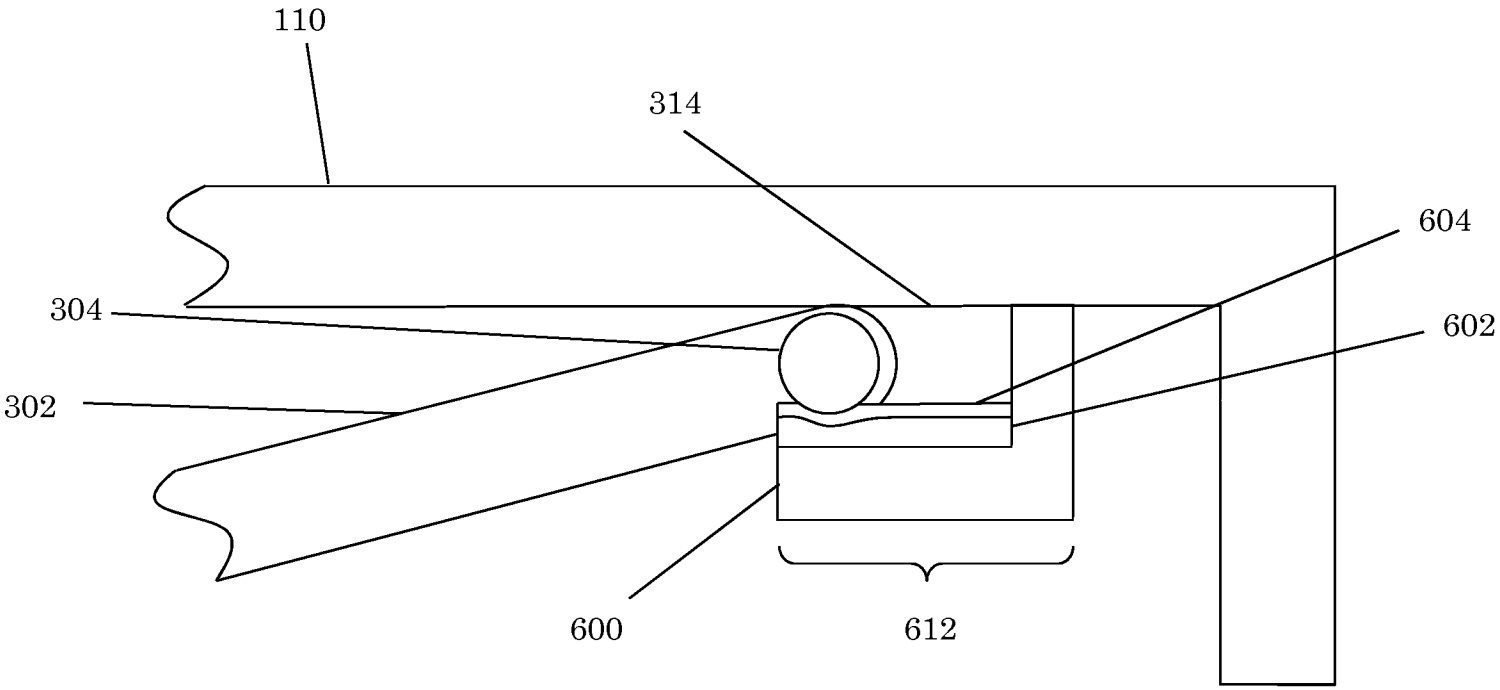
FIG. 6B is front cut-away drawing the example keyswitch mechanism FIG. 6A along line 6B-6B.

FIGS. 6A and 6B illustrate yet another example keyswitch mechanism having reduced key rattle. In this example embodiment, slide grooves 612 each have body 600 and a deformable contact surface that includes compressible layer 602 and flexible layer 604. This deformable contact surface may allow scissor contact surface 314 of keycap 110 to be held in contact with keycap bar 320 of first scissor arm 302 without binding the scissor mechanism. Scissor slide pins 304 are pressed against the respective deformable contact surfaces of the slide grooves 614 with sufficient pressure to deform the deformable contact surfaces. As in the previous described example embodiments, the tightening fitting of the scissor mechanism components generally leads to reduced key rattle.

In this example embodiment, compressible layer 602 may absorb the bulk of the pressure from scissor slide pins 304. Flexible layer 604 may serve to protect compressible layer 602. Alternatively (or additionally), flexible layer 604 may provide a lower friction layer to further avoid binding of the scissor mechanism. It is noted that, although illustrated as a two layer composite, the example deformable contact surface of slide groves 612 may be formed of a single compressible layer.

Figure 7:
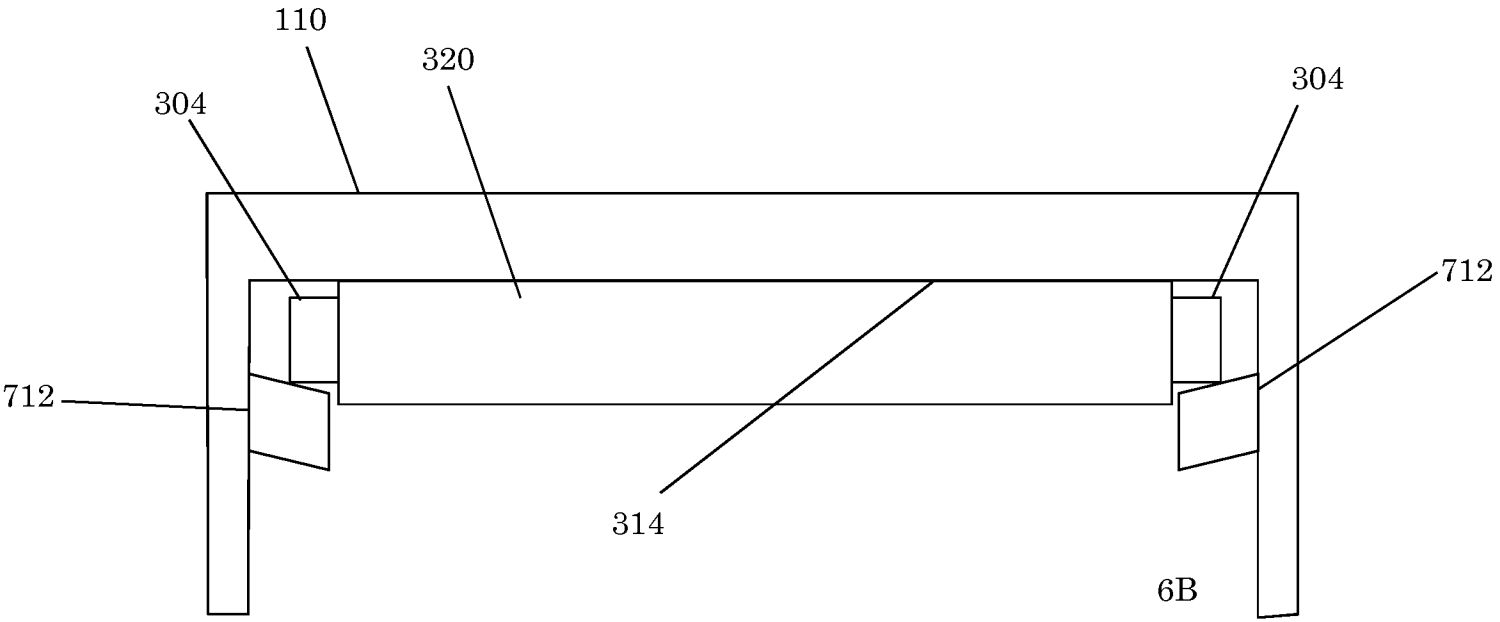
FIG. 7 is front cut-away drawing of yet an additional example keyswitch mechanism according to an embodiment.

FIG. 7 illustrates yet a further example keyswitch mechanism having reduced key rattle. In this example embodiment, slide grooves 712 are able to deform by flexing. As in the example embodiment of FIGS. 6A and 6B, this deformation of may slide grooves 712 allow scissor contact surface 314 of keycap 110 to be held in contact with keycap bar 320 of first scissor arm 302 without binding the scissor mechanism. Scissor slide pins 304 are pressed against the respective slide grooves 714 with sufficient pressure to slightly flex them. As in the previous described example embodiments, the tightening fitting of the scissor mechanism components may lead to reduced key rattle.

It is noted that tightening the fit of the scissor slide pins within the slide grooves of the keycap, as illustrated in each of the preceding example embodiments, may, in addition to reducing key rattle in the example keyswitch mechanism, also lead to increased friction between components of the keyswitch mechanism as they slide during key operation. In particular, this tightened fit may increase friction between the surface of the keycap bar and scissor contact surface and between the surface of scissor slide pins and the surface of slide grooves of the keycap. Therefore, it may be useful for one or more of these surfaces to be formed of a thermoplastic, such as nylon, high-density polyethylene (HDPE), or polytetrafluoroethylene (PTFE), to reduce the coefficient of friction between these surfaces.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context of particular embodiments. Functionality may be separated or combined in procedures differently in various embodiments of the disclosure or described with different terminology. These and other variations, modifications, additions, and improvements may fall within the scope of the disclosure as defined in the claims that follow.

We claim:

1. A keyswitch mechanism, comprising:
- a base;
- a keycap defining an actuation surface and a bottom surface opposite the actuation surface; and
- a keycap support arm coupling the keycap to the base, comprising:
  - a keycap bar; and
  - first and second connection members at opposite sides of the keycap bar and coupling the keycap to the keycap support arm; and
  - a protrusion extending from the keycap bar towards the bottom surface of the keycap and positioned between the first and second connection members, the protrusion contacting the bottom surface of the keycap to maintain a biasing force between the keycap support arm and the keycap.

2. The keyswitch mechanism of claim 1, wherein the protrusion and the keycap bar are integrally formed.

3. The keyswitch mechanism of claim 1, wherein the protrusion is at least one of:
- an arch in the keycap bar;
- a bump on the keycap bar; or
- a plurality of ridges on the keycap bar.

4. The keyswitch mechanism of claim 1, wherein:
- the first connection member is a first pin;
- the second connection member is a second pin; and
- the keycap includes first and second connection features, each receiving a respective pin therein, thereby coupling the keycap support arm to the keycap.

5. The keyswitch mechanism of claim 4, wherein:
- the first and second connection features each comprise a slide groove; and
- the first and second pins are slidably engaged with the first and second slide grooves, respectively.

6. The keyswitch mechanism of claim 1, wherein the keycap support arm is rotatably coupled to one of the keycap or the base, and is slidably coupled to the other of the keycap or the base.

7. The keyswitch mechanism of claim 1, wherein the keycap support arm is rotatably coupled to the keycap and the base.

8. A keyswitch mechanism, comprising:
- a base; and
- a keycap support arm coupling the base to a keycap and comprising:
  - first and second connection members; and
  - a keycap bar extending between the first and second connection members;
- the keycap comprising:
  - first and second connection features coupled to the first and second connection members; and
  - a protrusion extending from an area of a bottom surface of the keycap that is opposite an actuation surface of the keycap and between the first and second connection features, the protrusion extending towards and abutting the keycap bar to maintain a biasing force between the keycap support arm and the keycap.

9. The keyswitch mechanism of claim 8, wherein at least a portion of the keycap bar is elastically deformable.

10. The keyswitch mechanism of claim 8, wherein the protrusion is at least one of:
- a bump on an underside of the keycap; or
- a plurality of ridges on the underside of the keycap.

11. The keyswitch mechanism of claim 8, wherein:
- the first connection member is a first pin;
- the second connection member is a second pin; and
- the first and second connection features each receive a respective pin therein, thereby coupling the keycap support arm to the keycap.

12. The keyswitch mechanism of claim 8, wherein the keycap support arm is rotatably coupled to one of the keycap or the base, and is slidably coupled to the other of the keycap or the base.

13. A keyswitch mechanism, comprising:
- a base;
- a keycap; and
- a keycap support arm coupling the base to the keycap and comprising a connection member;
- the keycap comprising a slide groove disposed on an underside of the keycap and receiving the connection member therein; and
- a deformable member in the slide groove, wherein:
- the connection member translates within the slide groove during an actuation of the keycap;

the deformable member is deformed by the connection member, thereby forcing a portion of the keycap support arm against a portion of the keycap.

14. The keyswitch mechanism of claim 13, wherein:

a slide member forms a side of the slide groove; and the deformable member comprises a compressible layer on the slide member.

15. The keyswitch mechanism of claim 14, wherein the deformable member further comprises a flexible layer on the slide member.

16. The keyswitch mechanism of claim 15, wherein:

the compressible layer is above the slide member; and the deformable member is above the compressible layer.

17. The keyswitch mechanism of claim 16, wherein the flexible layer is configured to allow the connection member to slide thereover.

18. The keyswitch mechanism of claim 13, wherein the deformable member flexes in response to a force applied by the connection member.

* * * * *